US007409997B2

(12) United States Patent
Gay et al.

(10) Patent No.: US 7,409,997 B2
(45) **Date of Patent: *Aug. 12, 2008**

(54) ELECTRIC SUBMERSIBLE PUMP WITH SPECIALIZED GEOMETRY FOR PUMPING VISCOUS CRUDE OIL

(75) Inventors: Farral D. Gay, Claremore, OK (US); Mark C. James, Claremore, OK (US); Joseph E. Vandevier, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 262 days.

This patent is subject to a terminal disclaimer.

(21) Appl. No.: 10/946,892

(22) Filed: Sep. 22, 2004

(65) Prior Publication Data

US 2005/0034872 A1 Feb. 17, 2005

Related U.S. Application Data

(63) Continuation-in-part of application No. 10/079,374, filed on Feb. 20, 2002, now Pat. No. 6,854,517.

(51) Int. Cl.
*E21B 43/00* (2006.01)
*F04B 25/00* (2006.01)
*F04B 49/06* (2006.01)

(52) U.S. Cl. ..... 166/369; 166/68; 166/105; 417/44.1; 417/53; 417/247; 417/266; 417/242.2

(58) Field of Classification Search ..... 166/369, 166/381, 68, 66.4, 105, 106; 417/42, 43, 417/44.1, 53, 244, 247, 250, 251, 266, 321, 417/320, 410.1, 424.1, 424.2; 416/241 R, 416/223 B See application file for complete search history.

(56) References Cited

U.S. PATENT DOCUMENTS

| | | | | | |
|---|---|---|---|---|---|
| 2,726,606 | A | * | 12/1955 | Davidson | 417/247 |
| 2,839,005 | A | * | 6/1958 | Means | 417/247 |
| RE24,810 | E | * | 4/1960 | Buchi | 417/247 |
| 3,361,336 | A | * | 1/1968 | Foa | 417/53 |
| 3,568,771 | A | * | 3/1971 | Vincent et al. | 166/250.15 |
| 4,100,967 | A | * | 7/1978 | Allen et al. | 166/68 |
| 4,518,318 | A | | 5/1985 | Jensen et al. | |
| 4,678,404 | A | * | 7/1987 | Lorett et al. | 417/45 |
| 4,721,436 | A | | 1/1988 | Lepert | |
| 4,749,034 | A | * | 6/1988 | Vandevier et al. | 166/105 |
| 4,768,404 | A | | 9/1988 | Biegasnki | |
| 4,832,127 | A | * | 5/1989 | Thomas et al. | 166/369 |
| 4,958,988 | A | * | 9/1990 | Regev | 417/53 |
| 5,159,977 | A | * | 11/1992 | Zabaras | 166/105 |
| 5,385,447 | A | * | 1/1995 | Geister | 415/220 |
| 5,628,616 | A | * | 5/1997 | Lee | 415/58.2 |
| 5,803,713 | A | * | 9/1998 | Huse | 417/68 |
| 5,845,709 | A | * | 12/1998 | Mack et al. | 166/302 |
| 5,961,282 | A | * | 10/1999 | Wittrisch et al. | 415/199.6 |

(Continued)

*Primary Examiner*—Jennifer H Gay
*Assistant Examiner*—David Andrews
(74) *Attorney, Agent, or Firm*—Bracewell & Giuliani LLP

(57) ABSTRACT

A centrifugal pump has impellers for pumping low flow, high viscous materials. The impellers have high exit angles greater than 30 degrees and preferably greater than 50 degrees. The impellers and diffusers have specific geometry that varies with viscosity. The pump has zones of impellers and diffusers with the exit angles and geometry in the zones differing from the other zones. The exit angles decrease and geometry varies in a downstream direction to account for a lower viscosity occurring due to heat being generated in the pump. One design employs small diameter impellers and high rotational speeds.

21 Claims, 4 Drawing Sheets

U.S. PATENT DOCUMENTS 6,000,915 A * 12/1999 Hartman ..... 417/356
6,006,837 A 12/1999 Breit
6,076,599 A * 6/2000 McKinzie ..... 166/105
6,167,965 B1 * 1/2001 Bearden et al. ..... 166/250.15
6,190,141 B1 * 2/2001 Henry ..... 417/423.3
6,206,093 B1 * 3/2001 Lee et al. ..... 166/60
6,361,272 B1 * 3/2002 Bassett ..... 415/121.1
6,406,277 B1 * 6/2002 Shafer et al. ..... 417/424.2
6,412,562 B1 * 7/2002 Shaw ..... 166/335
6,499,954 B1 * 12/2002 Adonakis ..... 416/185
6,564,874 B2 * 5/2003 Narvaez ..... 166/372
6,676,366 B2 * 1/2004 Kao ..... 415/1
6,854,517 B2 * 2/2005 Gay et al. ..... 166/369
2005/0186065 A1 * 8/2005 Wilson et al. ..... 415/1

* cited by examiner

ELECTRIC SUBMERSIBLE PUMP WITH SPECIALIZED GEOMETRY FOR PUMPING VISCOUS CRUDE OIL

CROSS-REFERENCE TO RELATED APPLICATION

This application is a continuation-in-part of application Ser. No. 10/079,374, filed Feb. 20, 2002, now U.S. Pat. No. 6,854,517.

BACKGROUND OF THE INVENTION

1. Field of the Invention

This invention relates in general to electric submersible well pumps. More specifically, this invention relates to submersible well pumps that have an impeller configuration designed for high viscosity fluids and operate at high rotative speeds.

2. Description of the Prior Art

Traditionally the use of electric submersible pumps (ESP's) in low flow viscous crude pumping applications has been limited because of low efficiencies inherent with low capacity centrifugal pumps handling viscous fluids. Low efficiencies result from disk friction losses caused by a layer of viscous fluid adhering to the walls of both rotating and stationary components within the pump impeller and diffuser. Viscous fluids are considered herein to be fluids with a viscosity greater than 500 centipoise.

Others have made and used ESP's to pump viscous materials. However, most of these attempts have involved either modifying the material to be pumped or controlling the output of the pump motors with additional equipment to assist in the low flow conditions typical of pumping high viscous materials from wells.

Others have attempted to pump high viscous materials by simply lowering the viscosity of the material, as opposed to trying to modify the pump or motor to accommodate the high viscous materials. U.S. Pat. No. 6,006,837 to Breit (hereinafter "Breit Patent"), U.S. Pat. No. 4,721,436 to Lepert (hereinafter "Lepert Patent"), and U.S. Pat. No. 4,832,127 to Thomas et al. (hereinafter "Thomas Patent") are three such examples of this type of invention.

In the Breit Patent, the viscous fluids that are being pumped are heated in order to lower the viscosity of the fluid being pumped. The Lepert Patent discloses a process for pumping viscous materials by mixing the high viscosity materials with low viscosity materials with the use of a turbine-machine that consists of a turbine and a pump, separating the mixture, and recirculating the low viscosity materials for reuse. The Thomas Patent discloses a process for pumping viscous materials by mixing the high viscosity oil with water to lower the viscosity and then pump the material by conventional methods once the viscosity is suitable for pumping. Each of these references alters the fluid being pumped, without trying to modify the pump or motor to accommodate the fluid being pumped.

A need exists for an ESP and method of pumping high viscosity materials while maintaining pumping efficiencies, without altering the material being pumped or trying to maintain torque or rpm levels in a pump motor without the use of additional equipment. Ideally, such a system should be capable of being adapted to the specific applications and also be able to be used on existing equipment with minimal modification.

SUMMARY OF THE INVENTION

This invention provides a novel method and apparatus for pumping high viscous fluids from a well by utilizing variations of large impeller vane exit angles and geometry, optional zones with varying impeller angles and geometry in each zone, smaller diameter impellers, and high rotative speeds for pumping. The impeller vane exit angles are greater than 30 degrees and preferably greater than 50 degrees. The zones have impeller vane exit angles and geometry that vary from zone to zone. In the high rotative speed embodiments, the motor can rotate up to 10,500 rpm, and preferably above 5,000 rpm. When the motor is operated at such a high rotative speed, various impeller diameters can be used, while maintaining the same diameter shaft and diffuser height. The pump diameter can vary, but is limited based upon the fit-up arrangement in the well. Additionally, the present invention can be configured with any of the above traits in a variety of configurations.

Centrifugal pumps impart energy to the fluid being pumped by accelerating the fluid through the impeller. When the fluid leaves the impeller, the energy it contains is largely kinetic and must be converted to potential energy to be useful as head or pressure. In this invention, energy is imparted to the viscous fluid as rapidly as possible by using impeller vane geometry containing exit angles greater than 30 degrees. The use of large exit angles also minimizes vane length. Vane inlet angles in the range of 0 degrees to 30 degrees are used to minimize impact and angle-of-incidence losses. Diffuser vanes in this invention decelerate and direct the viscous fluid to the next pump stage as rapidly as possible using the same philosophy as used in the impeller, i.e. minimizing vane lengths and rapidly transitioning between the diffuser inlet and exit angles.

Inherent in the operation of centrifugal pumps, the energy dissipated as a result of frictional losses is absorbed as heat by the viscous crude oil, resulting in a temperature rise as the oil passes through the pump. The temperature rise in turn lowers the crude oil viscosity. The temperature rise can be significant in an ESP because of the length and number of stages contained in a typical ESP application. The present invention seeks to take advantage of the decreasing viscosity by assembling the pump in zones or modules with the impeller and diffuser geometry in each zone or module optimized for the viscosity and/or NPSH (net positive suction head) conditions of the viscous crude oil passing through that zone. Geometry refers to the configuration of the vanes with respect to the exit angles and number of vanes.

Flow rate varies directly with rotative speed and head or pressure varies with the square of rotative speed in centrifugal pumps. Reducing the impeller diameter minimizes disk friction but reduces the head and flow of the pump. When higher rotative speeds are coupled with vane geometry optimized for viscous pumping, performance per stage is restored and efficiency is further increased by reducing the amount of time in which the impeller and/or diffuser are in contact with the viscous fluids relative to the flow rate of the pump. As a practical limit, rotative speeds will be limited to 10,500 rpm, which corresponds to the speed of a two-pole electric motor operating at a frequency of 180 Hz. The present invention seeks to minimize disk friction by shortening the distance that the viscous fluid must travel as it moves through the pump. At the same time, clearances between rotating and stationary components are optimized to minimize the effect of boundary layer losses on non-pumping surfaces.

Frictional losses are also reduced by vanes with relatively large heights as well as short lengths. One method of quantifying a desired height is by a ratio, hereinafter referred to as performance ratio. The performance ratio is a quotient divided by the vane length. The quotient is the vane height over the impeller diameter. For viscous well fluids, a performance ratio of 0.075 is preferred. Typical conventional designs have performance ratios in the range from about 0.013 to 0.065.

BRIEF DESCRIPTION OF THE DRAWINGS

So that the manner in which the features, advantages and objects of the invention, as well as others which will become apparent, may be understood in more detail, more particular description of the invention briefly summarized above may be had by reference to the embodiment thereof which is illustrated in the appended drawings, which form a part of this specification. It is to be noted, however, that the drawings illustrate only a preferred embodiment of the invention and is therefore not to be considered limiting of the invention's scope as it may admit to other equally effective embodiments.

DETAILED DESCRIPTION OF THE INVENTION

Figure 1:
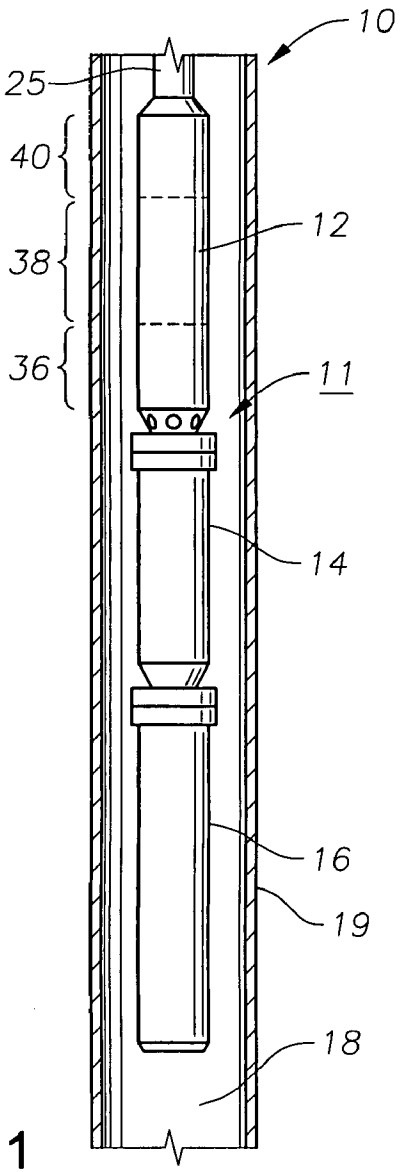
FIG. 1 is a perspective view of a centrifugal pump disposed in a viscous fluid within a well, constructed in accordance with this invention.
Figure 3:
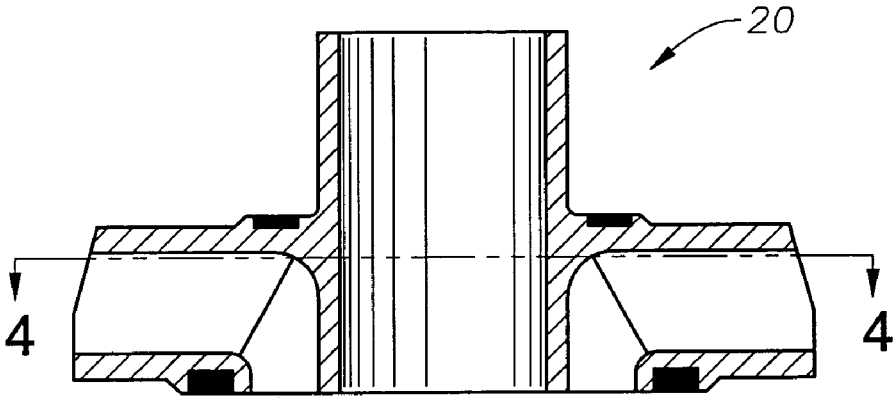
FIG. 3 is a cross-sectional view of an impeller of the centrifugal pump of FIG. 1.

Referring to the drawings, FIG. 1 generally depicts a well 10 with a submersible pump assembly 11 installed within. The pump assembly 11 comprises a centrifugal pump 12 that has a seal section 14 attached to it and an electric motor 16 submerged in a well fluid 18. The shaft of motor 16 connects to the seal section shaft 15 (not shown) and is connected to the centrifugal pump 12. The pump assembly 11 and well fluid 18 are located within a casing 19, which is part of the well 10. Pump 12 connects to tubing 25 that is needed to convey the well fluid 18 to a storage tank (not shown).

Motor 16 is preferably a three-phase AC motor that rotates at a speed dependent on the frequency of the electrical power supplied to it. Motor 16 may be driven by a fixed 60 Hz power supply. Alternately, a variable speed drive system may be employed with motor 16. Variable speed drive systems are conventional and allow an operator to change the frequency of the power supplied to motor 16 and thus the rotational speed of pump 12. If used, the operator will select a frequency for the variable speed drive based on expected conditions of the well. Pump 12 will then rotate at that constant speed until the operator subsequently decides to change the speed. Even if used with a variable speed drive system, normally, the pump assemblies 11 herein would not employ feedback circuitry to automatically change the frequency of the variable speed drive based on load or other factors. Consequently, pump assemblies 11 are operated at a constant speed, even though the operator may from time to time change that speed. Further, the sizes of motor 16 and pumps 12 herein are preferably selected to pump viscous well fluid at a rate of at least 500 barrels per day.

Figure 2:
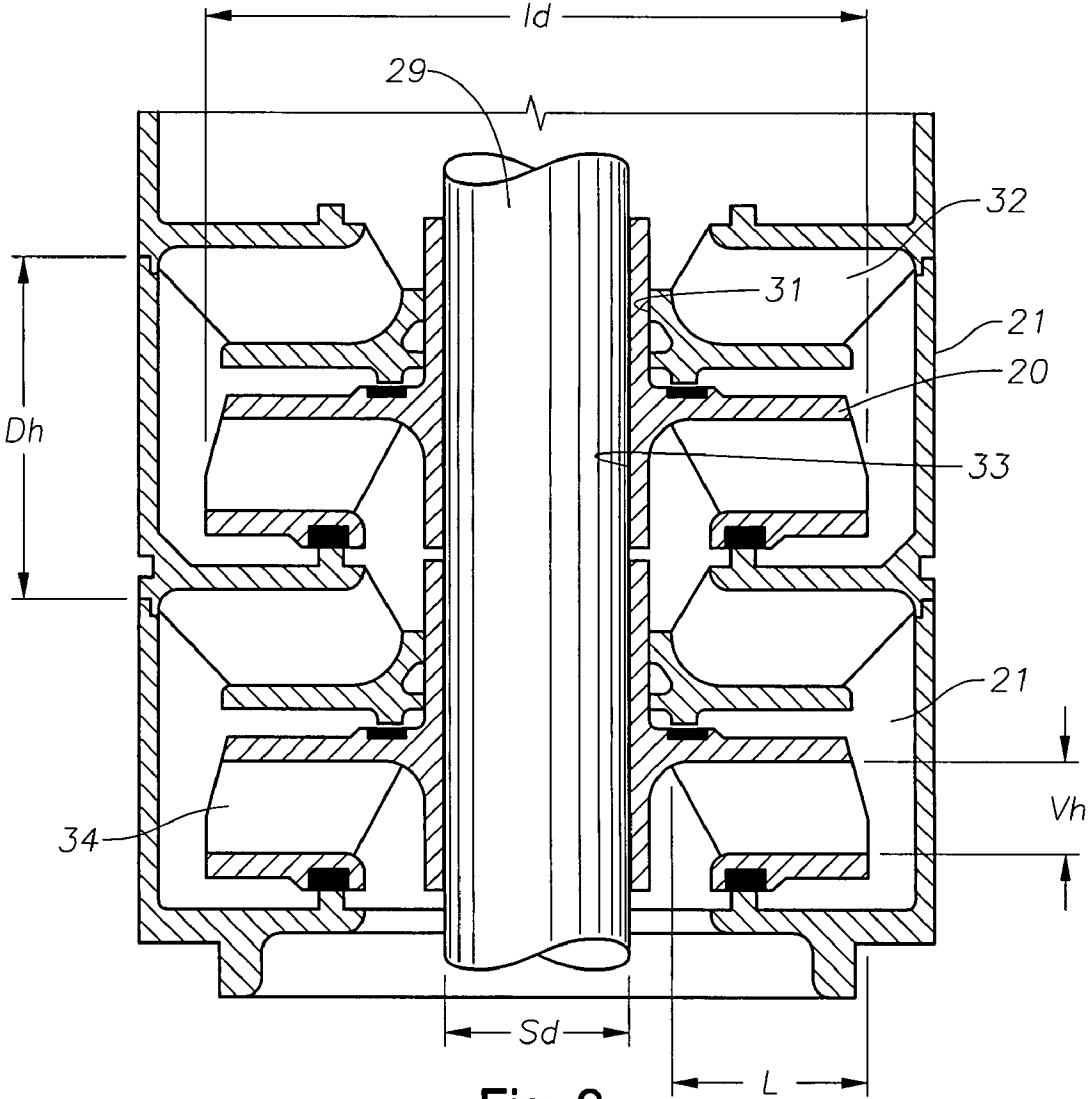
FIG. 2 is a cross-sectional view of two stages in the centrifugal pump of FIG. 1.

Referring to FIG. 2, centrifugal pump 12 has a housing 27 (not shown in FIG. 2) that protects many of the pump 12 components. Pump 12 contains a shaft 29 that extends longitudinally through the pump 12. Diffusers 21 have an inner portion with a bore 31 through which shaft 29 extends. Each diffuser 21 contains a plurality of passages 32 that extend through the diffuser 21. Each passage 32 is defined by vanes 23 (FIG. 6) that extend helically outward from a central area. Diffuser 21 is a radial flow type, with passages 32 extending in a radial plane.

Figure 4:
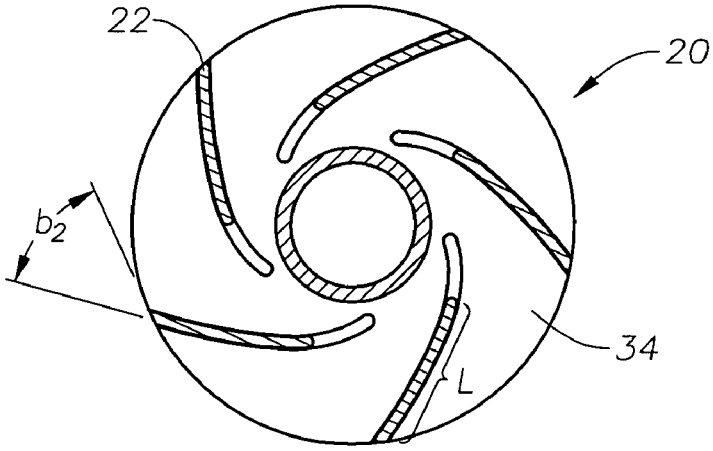
FIG. 4 is a sectional view of an impeller taken along the line 4-4 of FIG. 3 with 5 vanes, equally spaced.

An impeller 20 is placed within each diffuser 21. Impeller 20 also includes a bore 33 that extends the length of impeller 20 for rotation relative to diffuser 21 and is engaged with shaft 29. Impeller 20 also contains passages 34 that correspond to the openings in the diffuser 21. Passages 34 are defined by vanes 22 (FIG. 4). Washers are placed between the upper and lower portions between the impeller 20 and diffuser 21.

Impellers 20 rotate with shaft 29, which increases the velocity of the fluid 18 being pumped as the fluid 18 is discharged radially outward through passages 34. The fluid 18 flows inward through passages 32 of diffuser 21 and returns to the intake of the next stage impeller 20, which increases the fluid 18 pressure. Increasing the number of stages by adding more impellers 20 and diffusers 21 can increase the pressure of the fluid 18.

Figure 7:
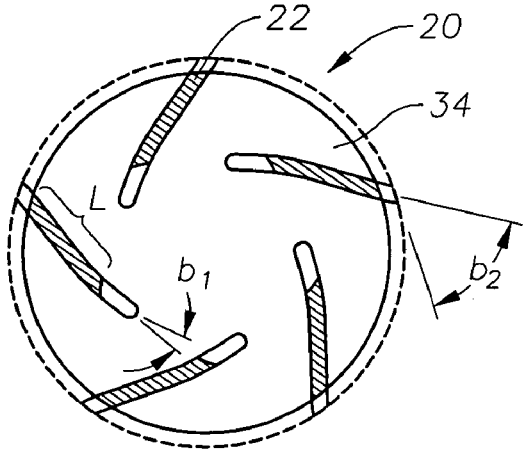
FIG. 7 is a sectional view of an impeller similar to the impeller of FIG. 4, but with a 50° exit angle.
Figure 8:
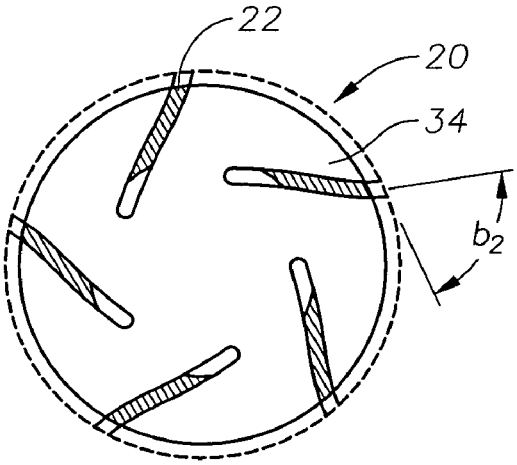
FIG. 8 is a sectional view of an impeller similar to the impeller of FIG. 4, but with a 60° exit angle.
Figure 9:
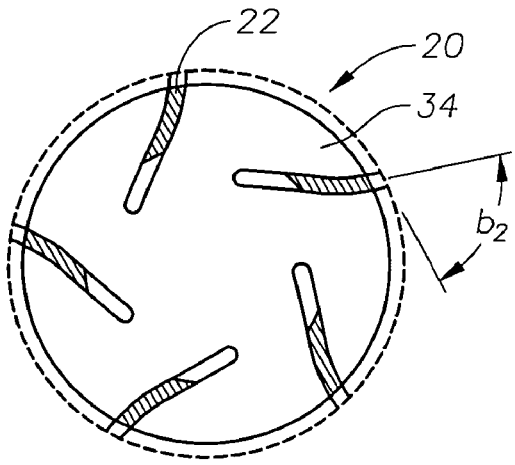
FIG. 9 is a sectional view of an impeller similar to the impeller of FIG. 4, but with a 70° exit angle.

As shown in FIGS. 4, 7, 8 and 9, the number of and exit angle b2 of the impeller vanes 22 and diffuser vanes 23 can vary. The exit angle b2 is measured from a line tangent to the circular periphery of impeller 20 to a line extending straight from vane 22. FIG. 4 is a cross-sectional view of impeller 20, which has five equally spaced impeller vanes 22 and with an exit angle b2 of 55 degrees. Passages 34 increase greatly in width and their flow area from the central areas to the periphery. FIGS. 7 through 9 show impellers with five equally spaced vanes with a discharge angle of b2, 50, 60, and 70 degrees respectively. The inlet angles b1 are in the range from 20 to 30 degrees for each impeller 20 of FIG. 4 and FIGS. 7 through 9. As the vane exit angle b2 increases, the vanes 22 become straighter and thus shorter. The length L from impeller 20 of FIG. 4 is longer than the length of the vanes 22 of the other Figures. A shorter vane 22 increases pressure head but, generally speaking, creates more turbulence losses. A shorter vane also reduces the effects of boundary layer.

Figure 5:
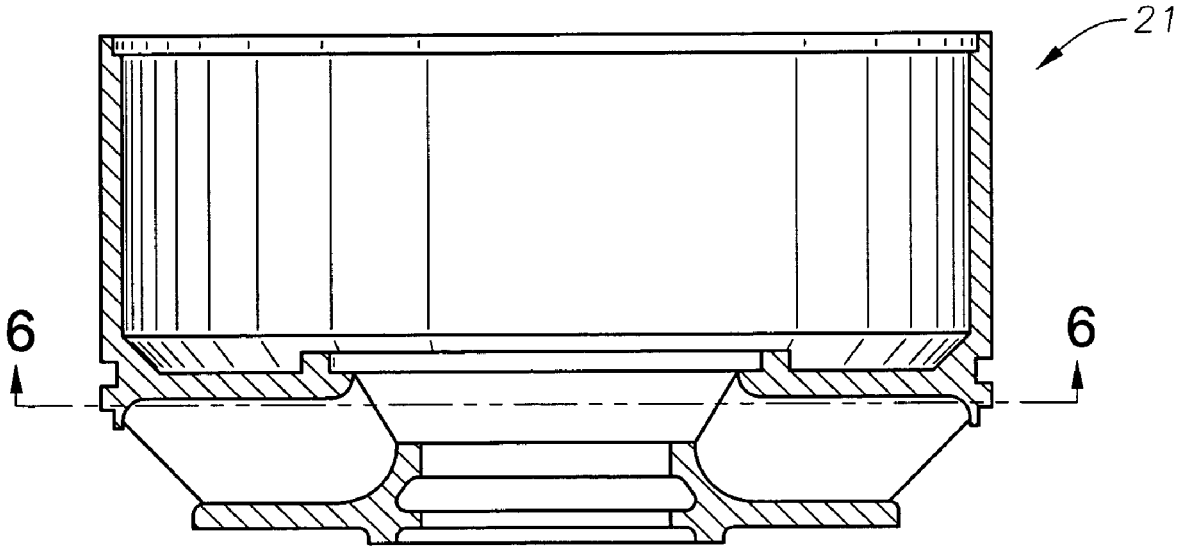
FIG. 5 is a cross-sectional view of a diffuser of the centrifugal pump of FIG. 1.
Figure 6:
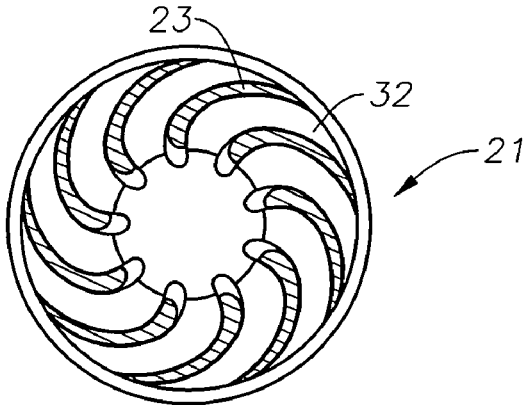
FIG. 6 is a sectional view of a diffuser showing nine diffuser vanes, equally spaced, taken along the line 7-7 of FIG. 5.

FIG. 6 depicts a cross-sectional view of diffuser 21, which has nine equally spaced vanes 23 taken along the line 6-6 of FIG. 5. The entrance and exit angles of vanes 23 are selected to minimize losses due to the angle of incidence and will depend on which impeller exit angle b2 is chosen. Each diffuser passage 32 increases in flow area from the periphery inward. As the shaft rotates impellers 20, fluid flows radially outward through passages 34. The velocity increases, then the energy is largely kinetic. The fluid turns upward and flows into diffuser passages 32. The velocity slows as the fluid flows radially inward, converting energy to potential energy. Diffuser vanes 23 decelerate and direct the viscous fluid to the next pump stage as rapidly as possible by minimizing the vane lengths and rapidly transitioning between the diffuser inlet and exit angles. Clearances between rotating and stationary pump components are also optimized to minimize the effect of boundary layer losses on non-pumping surfaces.

Referring to FIG. 2, preferably, vane passages 34 have a relatively large axial dimension or height Vh relative to the diameter Id of impeller 20. The vane height Vh is the height of each vane passage 34 measured from the lower to the upper sides of impeller 20. The desired vane height Vh has a relationship to the length L of each vane 22 (FIG. 4) and the impeller diameter Id. A ratio, referred to herein as a performance ratio, can be computed for impeller 20 by first determining the quotient of the vane height Vh divided by the impeller diameter Id, then dividing that quotient by the vane length L. For viscous well fluids, the performance ratio is preferably greater than 0.075. Two preferred embodiments of pumps in accordance with this invention have impellers 20 with performance ratios of 0.091 and 0.099, thus the performance ratios preferably exceeds 0.09 in some instances. As a comparison, conventional pumps of comparable size may have performance ratios of 0.013 to 0.065.

Centrifugal pump 12 can have a plurality of zones in order to take advantage of the viscosity change of the well fluid 18 as the fluid 18 is heated by the pumping process. Referring to FIG. 1, three zones 36, 38, and 40 are illustrated. Each zone comprises a plurality of impellers 20 and diffusers 21. Preferably all of the impellers 20 within a zone 36, 38, and 40 will have the same impeller vane 23 discharge angle b2 and performance ratio. Frictional losses cause a temperature rise across each stage that varies with viscosity. Consequently, the well fluid is more viscous in zone 36 than in zone 38, which in turn is more viscous than in zone 40. Consequently, the exit angle b2 in impellers 20 of zone 36 is higher than in zone 38. Similarly, the exit angle b2 in impellers 20 of zone 38 is higher than zone 40. The performance ratios in zones 36 and 38 would also differ because changing the exit angle b2 changes the vane length L (FIG. 4). As an example, zone 36 could be designed for greater than 500 centipoise viscosity, zone 38 for 300-500 centipoise, and zone 40 for 100-300 centipoise. There could be more than three zones and the stages in the zones do not have to be equal in number.

The method of pumping the viscous well fluid 18 with a submersible pump assembly 11 can also be accomplished by rotating the pump 12 at a higher speed than normally used with viscous fluids. High speed is defined herein as operating pump assembly 11 at a constant speed greater than 3,500 rpm and may be as high as about 10,500 rpm. One preferred speed is about 4375 rpm.

Figure 10:
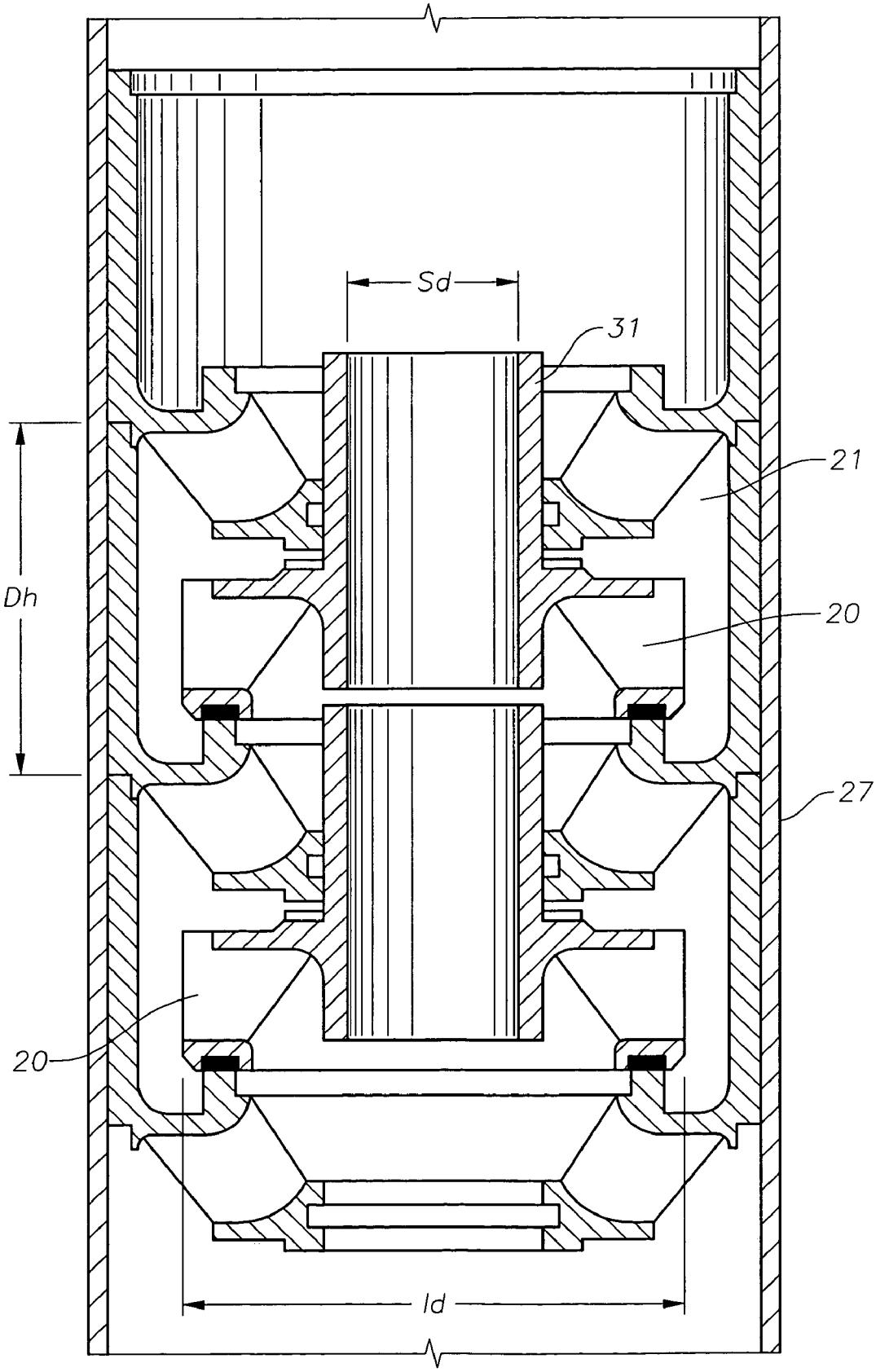
FIG. 10 is a partial cross-sectional view of two stages in a pump constructed in accordance with the invention, but with a shortened impeller diameter and higher rotating shaft speed.

The use of a constant high speed reduces the required diameter of the impellers, so a small impeller diameter 20, for example less than 2.75 inches, can be used in the high speed embodiments of this invention, as shown in FIG. 10. The impeller diameter Id can be shortened in this embodiment, while the shaft diameter Sd and the diffuser height Dh remain the same as in the lower constant speed embodiments of FIGS. 1-9. Any size diameter 20 can be used, but the size can be limited due to the pump fit-up arrangement in the well. As a result, the ratio of shaft diameter Sd to impeller diameter Id is at least 0.30 and preferably 0.33 and the ratio of diffuser height Dh to impeller diameter Id is at least 0.70 and preferably 0.72. The performance ratios preferably exceed 0.075. These ratios can be utilized in all embodiments of the invention that operate at a high constant pumping speed. In the embodiments of FIGS. 1-9, the ratio of shaft diameter Sd to impeller diameter Id is a prior art dimension of 0.28 and the ratio of diffuser height Dh to impeller diameter Id is a prior art dimension of 0.57.

The impellers 20 of FIG. 10 have the same high exit angles as in the other embodiments, preferably greater than 30 degrees. Also, impellers 30 of FIG. 10 have performance ratios greater than 0.075. Although the rotational speed is much higher than in the embodiments of FIGS. 1-9, the tip velocities are approximately the same because of the shorter radius. The typical prior art speed is 3,500 rpm. Reducing the impeller 20 diameter reduces disk friction but reduces the head and flow of the pump. Increasing the rotative speed increases head and flow. The higher rotative speed and high exit angle geometry are efficient for viscous fluids because of the reduced amount of time in which the impeller and/or diffuser are in contact with the viscous fluids relative to the flow rate of the pump.

The invention has significant advantages. The high exit angles increase pump efficiency for viscous fluids by shortening the lengths of the flow paths through the impellers. The multiple zones, each with impellers having different exit angles, allows optimizing as heat reduces the viscosity of the well fluid flowing through the pump. Higher rotative speeds and smaller diameter impellers also increases efficiency for viscous fluids.

While the invention has been shown or described in only some of its forms, it should be apparent to those skilled in the art that it is not so limited, but is susceptible to various changes without departing from the scope of the invention.

We claim:

1. A method of pumping a viscous fluid in a well, comprising:

(a) providing a centrifugal pump with a plurality of radial flow impellers having vanes with exit angles greater than 30 degrees, each exit angle being measured from a line tangent to a circular periphery of each impeller to a line extending straight from each vane;

(b) connecting an electric motor to the pump;

(c) lowering the pump and the motor into a viscous fluid in the well having a viscosity of at least 500 centipoise; and (d) rotating the impellers at a constant speed with the motor and thereby pumping viscous fluid from the well.

2. The method of claim 1, wherein step (d) comprises pumping at least 500 barrels of viscous fluid per day.

3. The method of claim 1, wherein step (a) comprises providing the impellers with exit angles greater than 50 degrees.

4. The method of claim 1, wherein step (a) comprises providing the impellers with a performance ratio greater than 0.075, the performance ratio being a quotient divided by vane length, the quotient being vane height over impeller diameter.

5. The method of claim 1, wherein step (a) comprises providing the impellers with a performance ratio greater than 0.09, the performance ratio being a quotient divided by vane length, the quotient being vane height over impeller diameter.

6. The method of claim 1, wherein step (d) comprises rotating the impellers at a speed greater than 3,500 rpm.

7. A method of pumping a fluid in a well, comprising:

(a) providing a centrifugal pump with a plurality of radial flow impellers having performance ratios greater than 0.075, each of the performance ratios being a quotient divided by vane length, the quotient being vane height over impeller diameter;

(b) lowering the pump into a fluid in the well; and (c) rotating the impellers and thereby pumping fluid from the well.

8. The method of claim 7, wherein step (a) comprises providing the impellers with vanes having exit angles greater than 30 degrees, each exit angle being measured from a line tangent to a circular periphery of each impeller to a line extending straight from each vane.

9. The method of claim 7, wherein step (a) comprises providing the impellers with vanes having exit angles greater than 50 degrees, each exit angle being measured from a line tangent to a circular periphery of each impeller to a line extending straight from each vane.

10. The method of claim 7, wherein step (c) comprises rotating the impellers at a speed greater than 3500 rpm.

11. The method of claim 7, wherein step (c) comprises pumping at least 500 barrels of fluid per day.

12. The method of claim 7, wherein step (c) comprises rotating the impellers at a constant speed.

13. The method of claim 7, wherein step (a) comprises providing the impellers with performance ratios greater than 0.9.

14. A method of pumping a viscous fluid in a well, comprising:

(a) providing a centrifugal pump with a plurality of radial flow impellers having vanes with exit angles greater than 30 degrees and performance ratios greater than 0.075, each exit angle being measured from a line tangent to a circular periphery of each impeller to a line extending straight from each vane, each of the performance ratios being a quotient divided by vane length, the quotient being vane height over impeller diameter;

(b) connecting an electric motor to the pump;

(c) lowering the pump and the motor into a viscous fluid in the well having a viscosity of at least 500 centipoise; and (d) rotating the impellers at a constant speed with the motor, and pumping viscous fluid from the well at a rate of at least 500 barrels per day.

15. The method of claim 14, wherein step (a) comprises providing the impellers with performance ratios greater than 0.09.

16. A well, comprising:

a casing;

a viscous well fluid with a viscosity of at least 500 centipoise contained in the casing;

a centrifugal pump located in the casing, the pump having a plurality of radial flow impellers with vanes that have exit angles greater than 30 degrees, each exit angle being measured from a line tangent to a circular periphery of each impeller to a line extending straight from each vane;

the impellers having performance ratios greater than 0.075, each of the performance ratios being a quotient divided by vane length, the quotient being vane height over impeller diameter;

a downhole motor connected to the pump for rotating the impellers; and wherein the motor and the pump have a capacity to pump more than 500 barrels of the viscous well fluid per day.

17. The well according to claim 16, wherein the exit angles are greater than 50 degrees.

18. The well according to claim 16, wherein the performance ratios are greater than 0.09.

19. A submersible well pumping assembly, comprising:

a plurality of radial flow impellers with vanes that have exit angles greater than 30 degrees, each exit angle being measured from a line tangent to a circular periphery of each impeller to a line extending straight from each vane;

the impellers having performance ratios greater than 0.075, each of the performance ratios being a quotient divided by vane length, the quotient being vane height over impeller diameter;

a downhole motor connected to the pump for rotating the impellers; and wherein the motor and the pump have a capacity to pump more than 500 barrels of well fluid per day.

20. The pumping assembly of claim 19, wherein the performance ratios are greater than 0.09.

21. The pumping assembly of claim 19, wherein the exit angles are greater than 50 degrees.

* * * * *